US008952998B2

(12) United States Patent
Gu et al.

(10) Patent No.: US 8,952,998 B2
(45) Date of Patent: Feb. 10, 2015

(54) ORGANIC LIGHT EMITTING DISPLAY APPARATUS

(75) Inventors: Bon-Seog Gu, Yongin (KR); Hae-Kwan Seo, Yongin (KR); Jun-Yi Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 198 days.

(21) Appl. No.: 13/533,897

(22) Filed: Jun. 26, 2012

(65) Prior Publication Data

US 2013/0208017 A1 Aug. 15, 2013

(30) Foreign Application Priority Data

Feb. 14, 2012 (KR) ..... 10-2012-0014827

(51) Int. Cl.
*G09G 5/10* (2006.01)

(52) U.S. Cl.
USPC ..... 345/690; 345/77

(58) Field of Classification Search
CPC ..... G09G 3/30; G09G 3/3208; G09G 3/3233; G09G 2310/027; G06F 3/1423; G06F 3/147
USPC ..... 345/87–100, 204–215, 690, 76–83
See application file for complete search history.

(56) References Cited

U.S. PATENT DOCUMENTS

| | | | | |
|---|---|---|---|---|
| 7,489,286 | B2 * | 2/2009 | Kawase et al. | 345/1.1 |
| 8,368,729 | B2 * | 2/2013 | Watanabe | 345/690 |
| 2004/0070809 | A1 * | 4/2004 | Senbonmatsu | 359/245 |
| 2005/0285811 | A1 * | 12/2005 | Kawase et al. | 345/1.1 |
| 2006/0267891 | A1 * | 11/2006 | Nishimura et al. | 345/87 |
| 2009/0174924 | A1 * | 7/2009 | Kubota | 359/259 |
| 2010/0259566 | A1 * | 10/2010 | Watanabe | 345/690 |
| 2011/0169720 | A1 | 7/2011 | Hwang et al. | |

FOREIGN PATENT DOCUMENTS

| | | | |
|---|---|---|---|
| JP | 2008-112112 | A | 5/2008 |
| KR | 10-2008-0056932 | A | 6/2008 |
| KR | 10-2011-0081629 | | 7/2011 |

* cited by examiner

*Primary Examiner* — Vijay Shankar
(74) *Attorney, Agent, or Firm* — Christie, Parker & Hale, LLP

(57) ABSTRACT

An organic light emitting display apparatus that is transparent and in which transmittance of external light is high and transmittance is locally different. The organic light emitting display apparatus includes: a first region comprising a plurality of pixels for displaying an image, a first transmitting unit, and a second transmitting unit, the first and second transmitting units being for transmitting external light, and the first transmitting unit being formed smaller than the second transmitting unit; and a second region comprising a plurality of pixels for displaying an image and another first transmitting unit for transmitting external light.

16 Claims, 7 Drawing Sheets

ORGANIC LIGHT EMITTING DISPLAY APPARATUS

CROSS-REFERENCE TO RELATED PATENT APPLICATION

This application claims priority to and the benefit of Korean Patent Application No. 10-2012-0014827, filed on Feb. 14, 2012, in the Korean Intellectual Property Office, the disclosure of which is incorporated herein in its entirety by reference.

BACKGROUND

1. Field

The present invention relates to an organic light emitting display apparatus, and more particularly, to a transparent organic light emitting display apparatus.

2. Description of the Related Art

Organic light emitting display apparatuses have a large viewing angle, better contrast characteristics, a faster response rate, and less power consumption, and thus the application of the Organic light emitting display apparatus is becoming wider, for example, from personal portable devices such as a moving picture experts group (MPEG) audio layer-3 (MP3 player or a mobile phone to a television (TV).

With respect to such an Organic light emitting display apparatus, there have been attempts to form the Organic light emitting display apparatus into a transparent display device by forming a thin film transistor or an organic light emitting device inside the Organic light emitting display apparatus in a transparent form.

Here, in such a transparent display apparatus, when the transparent display device is in a switch-off state, an object or an image that is positioned on the opposite side can be viewed by penetrating through the thin film transistor, the patterns such as various wiring lines, and a space between the patterns as well as the organic light emitting device. However, even in such a transparent display apparatus, light transmittances of the above-described organic light emitting device, the thin film transistor, and the wiring lines are not high and there are small spaces between the above-described elements, and thus the transmittance of the whole display is not high.

Also, there is a limitation that only the whole display screen having the same transmittance may be obtained.

SUMMARY

An aspect of an embodiment of the present invention is directed toward a transparent organic light emitting display apparatus.

According to an embodiment of the present invention, there is provided an organic light emitting display apparatus including: a first region including a plurality of pixels for displaying an image, a first transmitting unit, and a second transmitting unit, the first and second transmitting units being for transmitting external light, and the first transmitting unit being smaller than the second transmitting unit; and a second region including a plurality of other pixels for displaying an image and another first transmitting unit for transmitting external light.

The organic light emitting display apparatus may include a plurality of the first transmitting units (including the first transmitting unit) that are respectively located inside the pixels.

The second transmitting unit may be located between the pixels.

The second transmitting unit may be larger than at least one pixel.

The second transmitting unit may be connected to the first transmitting unit.

Each of the pixels may include an emission unit for displaying an image and a pixel circuit unit that is electrically connected to the emission unit, wherein the emission unit and the pixel circuit unit of each pixel overlap each other.

Each of the pixels may include an emission unit for displaying an image and a pixel circuit unit that is electrically connected to the emission unit, wherein the emission unit and the pixel circuit unit of each pixel do not overlap each other.

Each of the pixels may include an emission unit for displaying an image and a pixel circuit unit that is electrically connected to the emission unit, wherein the first transmitting unit and the second transmitting unit do not overlap with each emission unit.

Each of the pixels may include an emission unit for displaying an image and a pixel circuit unit that is electrically connected to the emission unit, wherein the first transmitting unit and the second transmitting unit do not overlap with each pixel circuit unit.

Each of the pixels may include a first emission unit, a second emission unit, and a third emission unit that emit light of different colors, respectively, and the first transmitting unit is located to correspond to the first to third emission units of one of the pixels that are disposed adjacent to one another.

The organic light emitting display apparatus may further include a common electrode that is formed over the first and second regions, wherein the common electrode may include a first opening corresponding to the first transmitting unit and a second opening corresponding to the second transmitting unit.

According to another embodiment of the present invention, there is provided an organic light emitting display apparatus including: a first display region in which an image is displayed and external light penetrates, wherein a user may observe an object positioned on the opposite side of the first display region; and a second display region in which an image is displayed and external light penetrates, wherein a user may observe an object positioned on the opposite side of the second display region, wherein transmittance of external light of the second display region is lower than that of the first display region.

The second display region may be connected to the first display region.

The first display region and the second display region may form one screen.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Now, an exemplary embodiment according to the present invention will be described in detail with reference to the accompanying drawings. As used herein, the term "and/or" includes any and all combinations of one or more of the associated listed items. Expressions such as "at least one of," when preceding a list of elements, modify the entire list of elements and do not modify the individual elements of the list.

Figure 1:
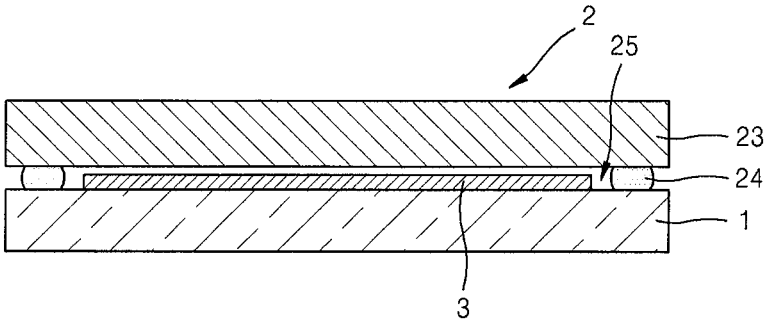
FIG. 1 is a schematic cross-sectional view of an organic light emitting display apparatus according to an embodiment of the present invention.

FIG. 1 is a schematic cross-sectional view of an organic light emitting display apparatus according to an embodiment of the present invention.

An organic emission unit 3 is formed on a first substrate 1, and an encapsulation unit 2 is disposed to face the first substrate 1. In the current embodiment, a second substrate 23 may be used as the encapsulation unit 2. The first substrate 1 and the second substrate 23 may be a glass substrate and/or a plastic substrate. Among the first substrate 1 and the second substrate 23, any one where an image is not displayed may use a metal substrate.

The first substrate 1 and the second substrate 23 are coupled to each other by using a sealant 24 positioned outside of an organic emission unit 3 to seal a space between the first substrate 1 and the second substrate 23. A moisture absorbent, a filling material, or the like may be disposed in the space.

Figure 2:
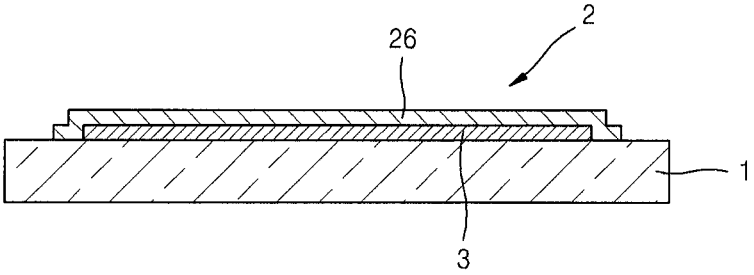
FIG. 2 is a schematic cross-sectional view of an organic light emitting display apparatus according to another embodiment of the present invention.

FIG. 2 is a schematic cross-sectional view of an organic light emitting display apparatus according to another embodiment of the present invention. An organic emission unit 3 is formed on a first substrate 1, and a sealing film 26 (e.g., formed as a thin film on the first substrate 1 to cover the organic emission unit 3) may be used as an encapsulation unit 2. The sealing film 26 may have a structure in which an inorganic film (formed of an inorganic material, such as aluminum oxide, silicon oxide or silicon nitride) and an organic film (formed of an organic material, such as epoxy or polyimide) are alternately stacked. However, the present invention is not limited thereto, and any one that has a transparent thin film shape and a sealing structure may be used.

Although not shown in the drawing, as the encapsulation unit 2 with respect to the organic emission unit 3, the sealing film 26 of FIG. 2 is formed, and then the second substrate 23 shown in FIG. 1 may further be included.

Figure 3:
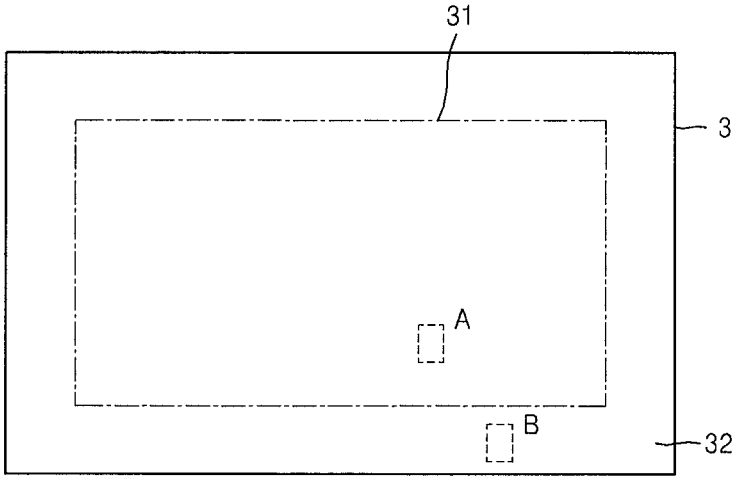
FIG. 3 is a plan view of a display region configured by the organic emission units of FIG. 1 or FIG. 2.

The organic emission unit 3 of the organic light emitting display apparatus configures a display region in which an image is displayed, as shown in FIG. 3. The organic emission unit 3 that serves as the display region includes a first region 31 and a second region 32. The first region 31 serves as a first display region in which an image is displayed, and the second region 32 serves as a second display region in which an image is displayed. The first region 31 and the second region 32 are connected to each other, and the same image may be displayed in the first region 31 and the second region 32, or alternatively, different images may be respectively displayed in the first region 31 and the second region 32. When the same image is displayed in the first region 31 and the second region 32, the first region 31 and the second region 32 form one screen.

In FIG. 3, the first region 31 is positioned in the middle of the organic emission unit 3, and the second region 32 is positioned at an edge (periphery) of the first region 31. However, the present invention is not limited thereto, and the positions of the first region 31 and the second region 32 may be reversed, or alternatively, the first region 31 may be positioned at the right half side of the organic emission unit 3 and the organic emission unit 3 may be positioned at the left half side of the organic emission unit 3. Alternatively, the first region 31 and the second region 32 may be a part of each other (e.g., overlapped with each other) in the organic emission unit 3.

Figure 4:
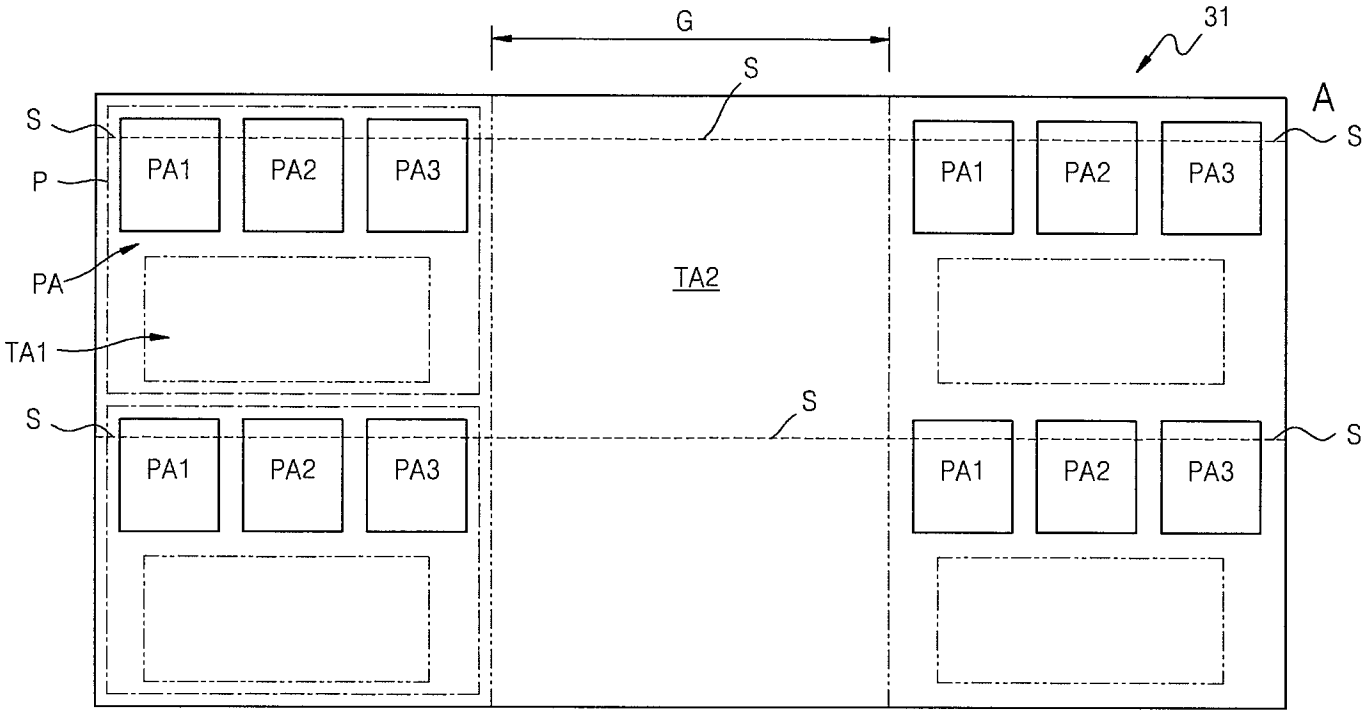
FIG. 4 is a plan view showing part "A" of FIG. 3.
Figure 5:
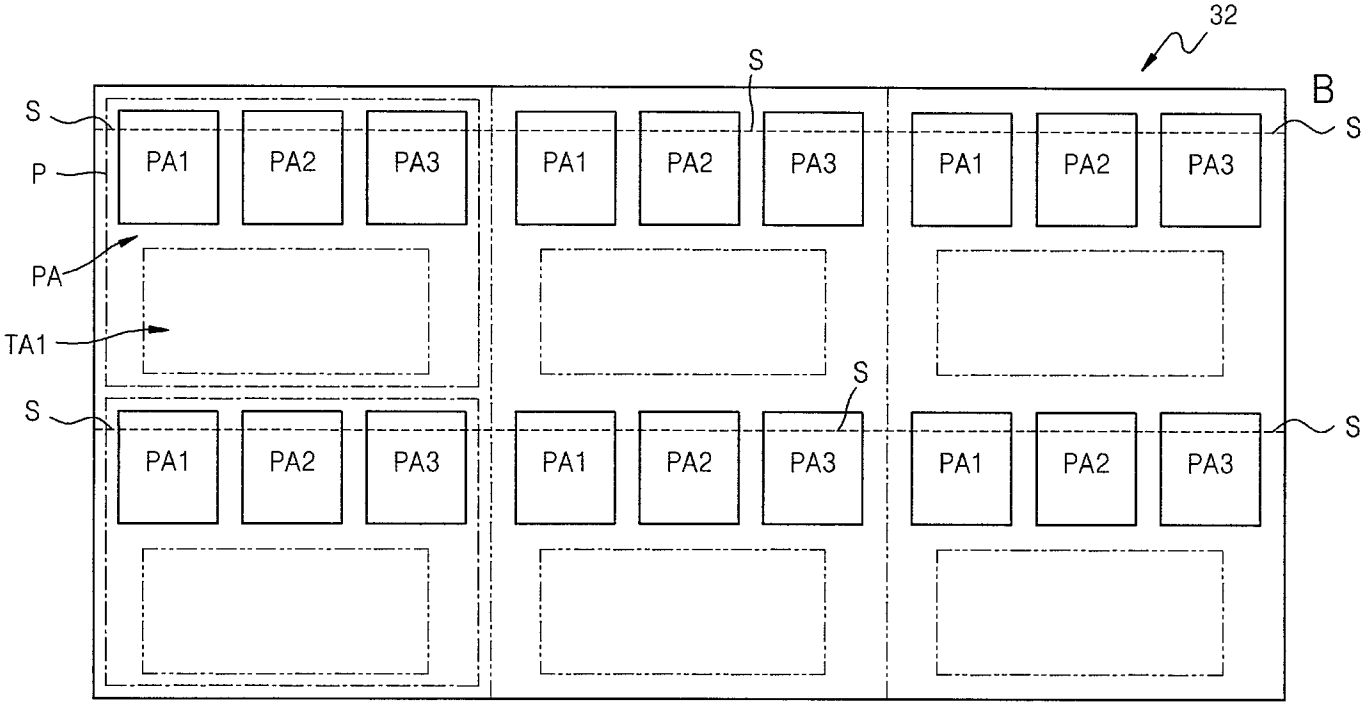
FIG. 5 is a plan view showing part "B" of FIG. 3.

FIG. 4 is an enlarged plane view showing part "A" including some pixels of the first region 31 of FIG. 3, and FIG. 5 is an enlarged plane view showing part "B" including some pixels of the second region 32 of FIG. 3.

Referring to FIGS. 3 and 4, the first region 31 includes a first transmitting unit TA1 and a second transmitting unit TA2 that transmit external light. External light penetrates through the first transmitting unit TA1 and the second transmitting unit TA2 so that a user may observe an object positioned on the opposite side to a surface in which an image is displayed.

Here, the first transmitting unit TA1 may be formed to have a smaller area than the second transmitting unit TA2. Accordingly, transmittance of external light in the first transmitting unit TA1 is lower than that in the second transmitting unit TA2.

Referring to FIGS. 3 and 5, the second region 32 includes the first transmitting unit TA1 that transmits external light. The first transmitting unit TA1 is the same as the first transmitting unit TA1 of the first region 31 shown in FIG. 4.

Accordingly, transmittance of external light of the first region 31 including both the first transmitting unit TA1 and the second transmitting unit TA2 is higher than that of the second region 32 including only the first transmitting unit TA1. Thus, a user may easily observe an object positioned on the opposite side to a surface in which an image is displayed through the first region 31.

Each of a plurality of pixels P of the first region 31 includes a plurality of emission units PA for displaying an image. Each pixel P includes a first emission unit PA1, a second emission unit PA2, and a third emission unit PA3 that emit light of different colors, respectively. The pixel P may display full white by the first emission unit PA1, the second emission unit PA2, and the third emission unit PA3. According to the current embodiment, the first emission unit PA1, the second emission unit PA2, and the third emission unit PA3 may be a red sub-pixel, a green sub-pixel, and a blue sub-pixel, respectively.

A plurality of the first transmitting units TA1 are positioned inside the respective pixels P. At this time, as shown in FIG. 4, one first transmitting unit TA1 is disposed adjacent and corresponding to the first emission unit PA1, the second emission unit PA2, and the third emission unit PA3 in one pixel P. In other words, one first transmitting unit TA1 is positioned to correspond to the first emission unit PA1, the second emission unit PA2, and the third emission unit PA3 that constitute one pixel P. In one pixel P, the first transmitting unit TA1 is formed in such a way that a region adjacent to the first emission unit PA1, a region adjacent to the second emission unit PA2, and a region adjacent to the third emission unit PA3 are connected to one another. However, the present invention is not limited thereto, and the first transmitting unit TA1 may be divided into regions that are respectively adjacent to the first emission unit PA1, the second emission unit PA2, and the third emission unit PA3.

In addition, the second transmitting unit TA2 is disposed between the pixels P. The second transmitting unit TA2 may be larger than at least one pixel P. Accordingly, a greater amount of external light may penetrate the second transmitting unit TA2 than the first transmitting unit TA1.

The second transmitting unit TA2 may be disposed between rows of the pixels P as shown in FIG. 4. At this time, the second transmitting unit TA2 may have a linear shape extending downward, like the rows of the pixels P. A width G of the second transmitting unit TA2 having a linear shape may correspond to a width of the pixel P.

In the first region 31, the first transmitting unit TA1 and the second transmitting unit TA2 do not overlap with the first emission unit PA1 to the third emission unit PA3. Accordingly, an emission region and a penetration region are separated from each other, and thus a user may easily observe a penetration image of an object positioned beyond a screen while seeing an image by the emission region.

The second region 32, as shown in FIG. 5, includes only the first transmitting unit TA1 disposed inside the pixel P. The first to third emission units PA1 to PA3 and the first transmitting unit TA1 of the pixel P have the same structures as those of the first region 31 as described above.

Figure 6:
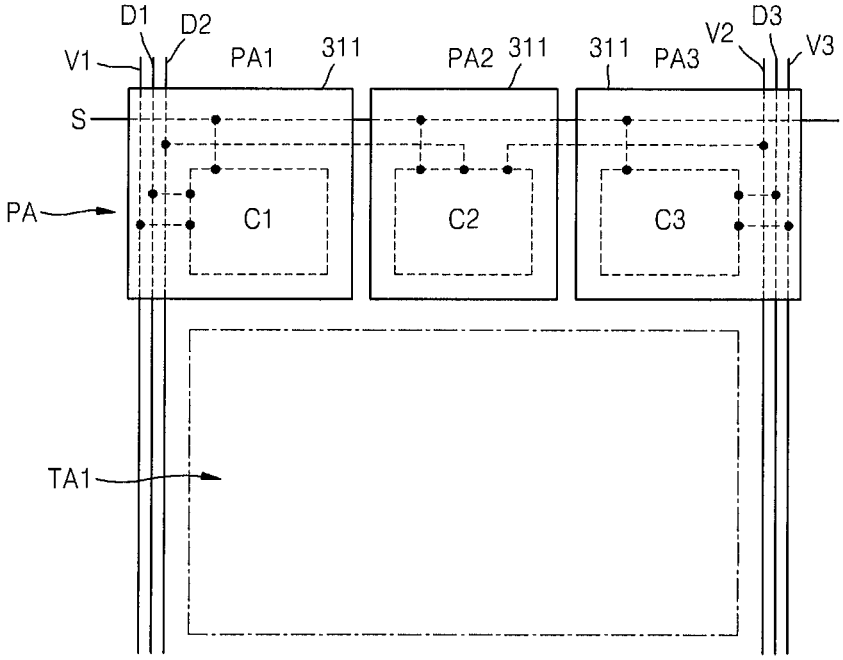
FIG. 6 is a plan view showing one pixel shown in FIGS. 4 and 5.

FIG. 6 is a plane view showing one pixel shown in FIGS. 4 and 5.

Figure 7:
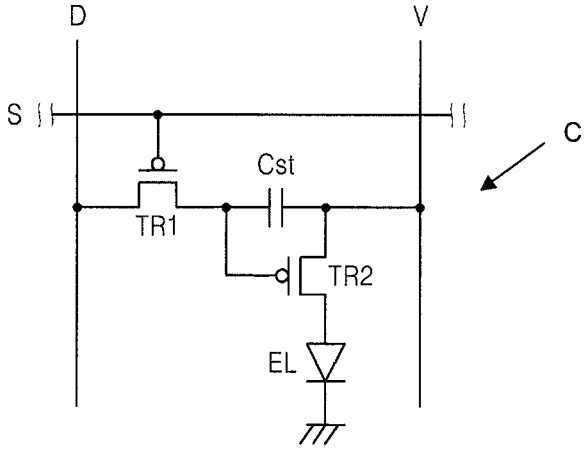
FIG. 7 is a circuit diagram showing a circuit unit of FIG. 6.

The pixel P includes first to third circuit units C1 to C3 that overlap with the first to third emission units PA1 to PA3. FIG. 7 is a circuit diagram showing the first to third circuit units C1 to C3.

Referring to FIG. 7, a scan line S, a data line D, and a Vdd line V, which is a driving power source, are electrically connected to a circuit unit C (e.g., the first circuit unit C1, the second circuit unit C2, or the third circuit unit C3). Although shown in FIG. 7, in addition to the scan line S, the data line D, and the Vdd line V, various other suitable conductive lines may further be included according to configuration of the circuit unit C.

The circuit unit C includes the first thin film transistor TR1 connected to the scan line S and the data line D, the second thin film transistor TR2 connected to the first thin film transistor TR1 and the Vdd line V, and a capacitor Cst connected to the first thin film transistor TR1 and the second thin film transistor TR2.

A gate electrode of the first thin film transistor TR1 is connected to the scan line S to receive a scan signal, a first electrode is connected to the data line D, and a second electrode is connected to the capacitor Cst and the gate electrode of the second thin film transistor TR2. The first electrode of the second thin film transistor TR2 is connected to the Vdd line V and the capacitor Cst, and the second electrode is connected to an organic electro luminescence (EL). The first thin film transistor TR1 serves as a switching transistor, and the second thin film transistor TR2 serves as a driving transistor.

Referring to FIG. 6, one scan line S is connected to the first to third circuit units C1 to C3. Referring to FIGS. 4 and 5, all the pixels that are arranged in a horizontal direction are connected to one scan line S. Since the first to third circuit units C1 to C3 overlap with the first to third emission units PA1 to PA3, the first to third circuit units C1 to C3 do not overlap with the first transmitting unit TA1. Accordingly, the first to third circuit units C1 to C3 do not adversely affect transmittance of external light.

Since the first to third emission units PA1 to PA3 are arranged adjacent to one first transmitting unit TA1, first to third data lines D1 to D3 respectively connected to the first to third circuit units C1 to C3 are positioned at both edges outside of the first transmitting unit TA1. Referring to FIG. 6, the first data line D1 and the second data line D2 are positioned at a left edge outside of the first transmitting unit TA1, and the third data line D3 is positioned at a right edge outside of the first transmitting unit TA1. Accordingly, the first to third data lines D1 to D3 do not overlap with the first transmitting unit TA1.

First to third Vdd lines V1 to V3 respectively connected to the first to third circuit units C1 to C3 are positioned at both edges outside of the first transmitting unit TA1. Referring to FIG. 6, the first Vdd line V1 is positioned at a left edge outside of the first transmitting unit TA1, and the second and third Vdd lines V2 and V3 are positioned at a right edge outside of the first transmitting unit TA1. Accordingly, the first to third Vdd lines V1 to V3 do not overlap with the first transmitting unit TA1.

As such, since the first to third data lines D1 to D3 and/or the first to third Vdd lines V1 to V3 do not overlap with the first transmitting unit TA1, transmittance of the first transmitting unit TA1 may be prevented from being decreased due to wiring lines such as the data lines and the Vdd lines.

The above-described arrangements of the first to third data lines D1 to D3 and/or the first to third Vdd lines V1 to V3 are not limited to those shown in FIG. 6, and may be modified in various suitable ways. For example, the first and second Vdd lines V1 and V2 and the first data line D1 may be positioned at the left edge outside of the first transmitting unit TA1, and the third Vdd line V3 and the second and third data lines D2 and D3 may be positioned at the right edge outside of the first transmitting unit TA1. At least one of the first to third Vdd lines V1 to V3 may be omitted, and thus two circuit units may be connected to one Vdd line.

In addition, the first to third emission units PA1 to PA3 include pixel electrodes 311, respectively. The pixel electrode 311 is one electrode of the organic EL of FIG. 7. Referring to FIG. 6, the scan line S, the first to third data lines D1 to D3, and the first to third Vdd lines V1 to V3 overlap with the pixel electrode 311. This is to increase transmittance of external light of the first transmitting unit TA1 by allowing the wiring lines to overlap with the emission units.

Figure 8:
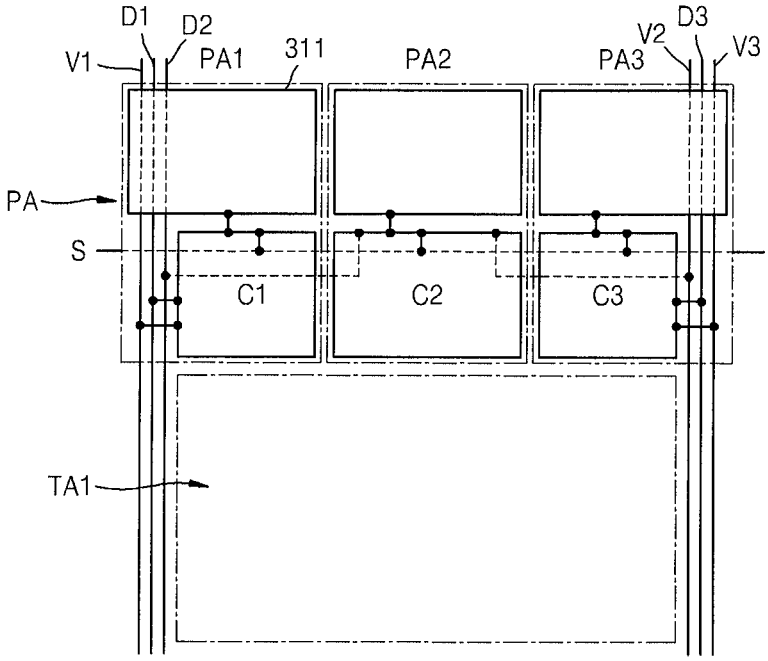
FIG. 8 is a plan view showing one pixel shown in FIGS. 4 and 5 according to another embodiment of the present invention.

FIG. 8 is a plane view showing one pixel shown in FIGS. 4 and 5 according to another embodiment of the present invention.

Unlike the embodiment shown in FIG. 6, in the embodiment shown in FIG. 8, the first to third circuit units C1 to C3 do not overlap with the first to third emission units PA1 to PA3. Accordingly, the first to third circuit units C1 to C3 do not overlap with the pixel electrodes 311 of each emission unit. Thus, in a bottom emission type display and according to one embodiment, light emitted from the first to third emission units PA1 to PA3 are not interfered (blocked) by the first to third circuit units C1 to C3. The rest of the elements of the pixel P are the same as those of the embodiment shown in FIG. 6, and thus a detailed description thereof will be omitted.

Figure 9:
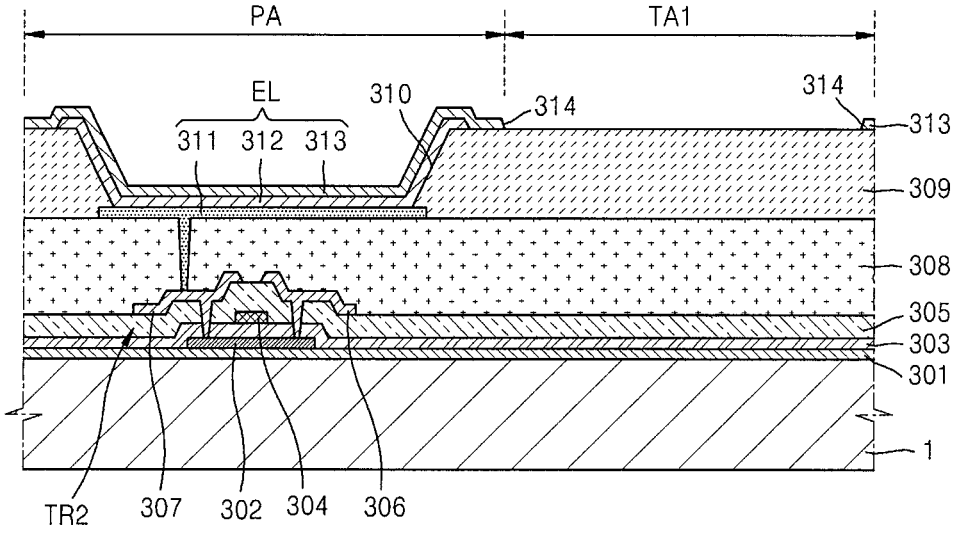
FIG. 9 is a cross-sectional view showing a pixel shown in FIG. 4, an emission unit, and a first transmitting unit that are shown in FIG. 6.

FIG. 9 is a cross-sectional view showing the pixel P shown in FIG. 4, one emission unit PA, and the first transmitting unit TA1 that are shown in FIG. 6

Figure 10:
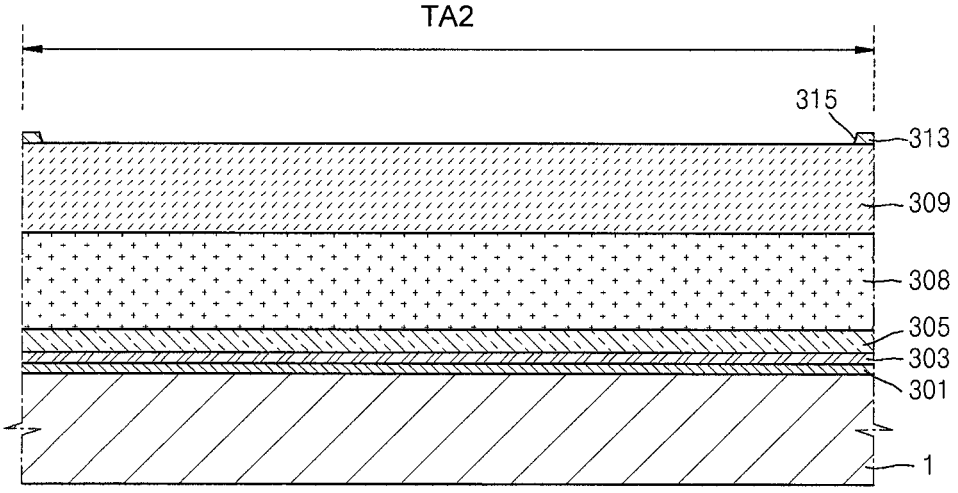
FIG. 10 is a cross-sectional view of a second transmitting unit shown in FIG. 4.

FIG. 10 is a cross-sectional view of the second transmitting unit TA2 shown in FIG. 4.

Referring to FIG. 9, the organic EL, which is formed of an organic material, is disposed in the emission unit PA. The organic EL is electrically connected to the second thin film transistor TR2 of the circuit unit C as shown in FIG. 7.

A buffer layer 301 is formed on the first substrate 1, and a circuit unit including the second thin film transistor TR2 is formed on the buffer layer 301.

First, a semiconductor active layer 302 is formed on the buffer layer 301.

The buffer layer 301, formed of a transparent insulating material, prevents penetration of impurities, and planarizes a surface of the first substrate 1. The buffer layer 301 may be formed of any of various materials capable of performing the above-described functions. For example, the buffer layer 301 may be formed of an inorganic material such as silicon oxide, silicon nitride, silicon oxynitride, aluminum oxide, aluminum nitride, titanium oxide, or titanium nitride, or an organic material such as polyimide, polyester, or acryl, or the buffer layer 301 may have a stacked structure of the inorganic material and the organic material. The buffer layer 301 is not an essential element, and may not be included as designed or required.

The semiconductor active layer 302 may be formed of polycrystalline silicon. However, the present invention is not limited thereto, and may be formed of an oxide semiconductor. For example, the semiconductor active layer 302 may be a G-I-Z-O layer [$(In_2O_3)a(Ga_2O_3)b(ZnO)c$ layer] (wherein a, b, and c are real numbers that satisfy conditions $a \geq 0$, $b \geq 0$, and $c > 0$, respectively). When the semiconductor active layer 302 is formed of an oxide semiconductor, light transmittance of a thin film transistor may further be increased, and thus transmittance of external light of the organic emission unit 3 may be increased (refer to FIGS. 1 and 2).

A gate insulating layer 303 formed of a transparent insulating material is formed on the buffer layer 301 to cover the semiconductor active layer 302, and a gate electrode 304 is formed on the gate insulating layer 303.

An insulating interlayer 305 formed of a transparent insulating material is formed on the gate insulating layer 303 to cover the gate electrode 304, and a source electrode 306 and a drain electrode 307 are formed on the insulating interlayer 305 to contact the semiconductor active layer 302 via a contact hole.

The present invention is not limited to the above-described structure of the second thin film transistor TR2, and the structure of the second thin film transistor TR2 may be modified in various suitable ways.

A passivation layer 308 is formed to cover the circuit unit including the second thin film transistor TR2. The passivation layer 308 may be an insulating layer that includes a planarized top surface and has a single-layered structure or a multi-layered structure. The passivation layer 308 may be formed of a transparent inorganic insulating layer and/or a transparent organic insulating layer. The passivation layer 308 may be formed all over the pixels P.

A pixel electrode 311 of the organic EL electrically connected to the second thin film transistor TR2 is formed on the passivation layer 308 as shown in FIG. 9. The pixel electrode 311 is formed in an island shape that is individually separated in each sub-pixel, that is, each emission unit PA.

A pixel defining layer 309 formed of an organic insulating material and/or an inorganic insulating material is formed on the passivation layer 308.

The pixel defining layer 309 covers both edge portions of the pixel electrode 311 and exposes a center portion of the pixel electrode 311. The pixel defining layer 309 may be formed to cover the first transmitting unit TA1. However, the pixel defining layer 309 may not necessarily cover the entire first transmitting unit TA1, and the pixel defining layer 309 may cover at least a part of the first transmitting unit TA1, in particular, both edge portions of the pixel electrode 311.

An organic layer 312 and an opposite electrode 313 are sequentially stacked on the pixel electrode 311. The opposite electrode 313 covers the organic layer 312 and the pixel defining layer 309 and is electrically connected to all the pixels P and all the emission units PA.

The organic layer 312 may be a low-molecular weight organic layer or a polymer organic layer. When the organic layer 312 is a low-molecular weight organic layer, a hole injection layer (HIL), a hole transport layer (HTL), an emission layer (EML), an electron transport layer (ETL), and an electron injection layer (EIL) may be stacked to have a single-layered structure or a multi-layered structure. Examples of available organic materials may include copper phthalocyanine (CuPc), N,N'-di(naphthalene-1-yl)-N,N'-diphenyl-benzidine (NPB), tris-8-hydroxyquinoline aluminum (Alq3), and the like. The low-molecular weight organic layer may be formed by vacuum deposition. Here, the HIL, the HTL, the ETL, the EIL, etc. are common layers and may be used in red, green, and blue pixels.

The pixel electrode 311 serves as an anode, and the opposite electrode 313 serves as a cathode. It should be apparent that polarities of the electrodes may be inversed.

According to the current embodiment, the pixel electrode 311 may be formed of a high-work function material, for example, indium tin oxide (ITO), indium zinc oxide (IZO), zinc oxide (ZnO), $In_2O_3$, etc. The opposite electrode 313 may be formed of a low-work function metal, for example, silver (Ag), magnesium (Mg), aluminum (Al), platinum (Pt), palladium (Pd), gold (Au), nickel (Ni), neodymium (Nd), iridium (Ir), chromium (Cr), lithium (Li), or calcium (Ca). The organic EL may be a top emission type in which an image is displayed toward the opposite electrode 313. To improve luminance efficiency, the pixel electrode 311 may further include a reflection film, and the opposite electrode 313 may be formed as a thin film that is formed to be a transparent film or a semi-permeable reflection film.

In the embodiment shown in FIG. 8, the organic EL may be a bottom emission type in which an image is displayed toward the pixel electrode 311. At this time, the pixel electrode 311 may be a transparent electrode, and the opposite electrode 313 may be a reflection electrode. When the organic EL is a double-side emission type, the opposite electrode 313 may be formed as a transparent film or a semi-permeable reflection film.

The buffer layer 301, the gate insulating layer 303, the insulating interlayer 305, the passivation layer 308, and the pixel defining layer 309 may be formed as a transparent layer to improve transmittance with respect to external light.

Also, as shown in FIG. 10, the buffer layer 301, the gate insulating layer 303, the insulating interlayer 305, the passivation layer 308, and the pixel defining layer 309 are sequentially formed on the first substrate 1 in a region corresponding to the second transmitting unit TA2. An emission unit does not exist in the region corresponding to the second transmitting unit TA2 as shown in FIG. 4.

In addition, a first opening 314 may be formed in the region corresponding to the first transmitting unit TA1 of the opposite electrode 313 as shown in FIG. 9. A second opening 315 may be formed in the region corresponding to the second transmitting unit TA2 of the opposite electrode 313 as shown in FIG. 10.

Since the opposite electrode 313 formed of a metal decreases transmittance of external light, the first opening 314 and the second opening 315 may be formed in the regions corresponding to the first transmitting unit TA1 and the second transmitting unit TA2, respectively, as shown in FIGS. 9 and 10, to improve transmittance of external light in the first transmitting unit TA1 and the second transmitting unit TA2. However, the present invention is not limited thereto, and when the opposite electrode 313 is formed to improve luminescence transmittance, the first opening 314 and/or the second opening 315 may not be formed. Also, in FIGS. 9 and 10, although the first opening 314 and the second opening 315 are formed only in the opposite electrode 313, the present invention is not limited thereto, and the first opening 314 and/or the second opening 315 may be formed in at least one insulating layer of the pixel defining layer 309, the passivation layer 308, the insulating interlayer 305, the gate insulating layer 303, and the buffer layer 301 to extend.

The structure of the pixel shown in FIG. 9 may be used in the pixel of the second region 32 of FIG. 5.

Figure 11:
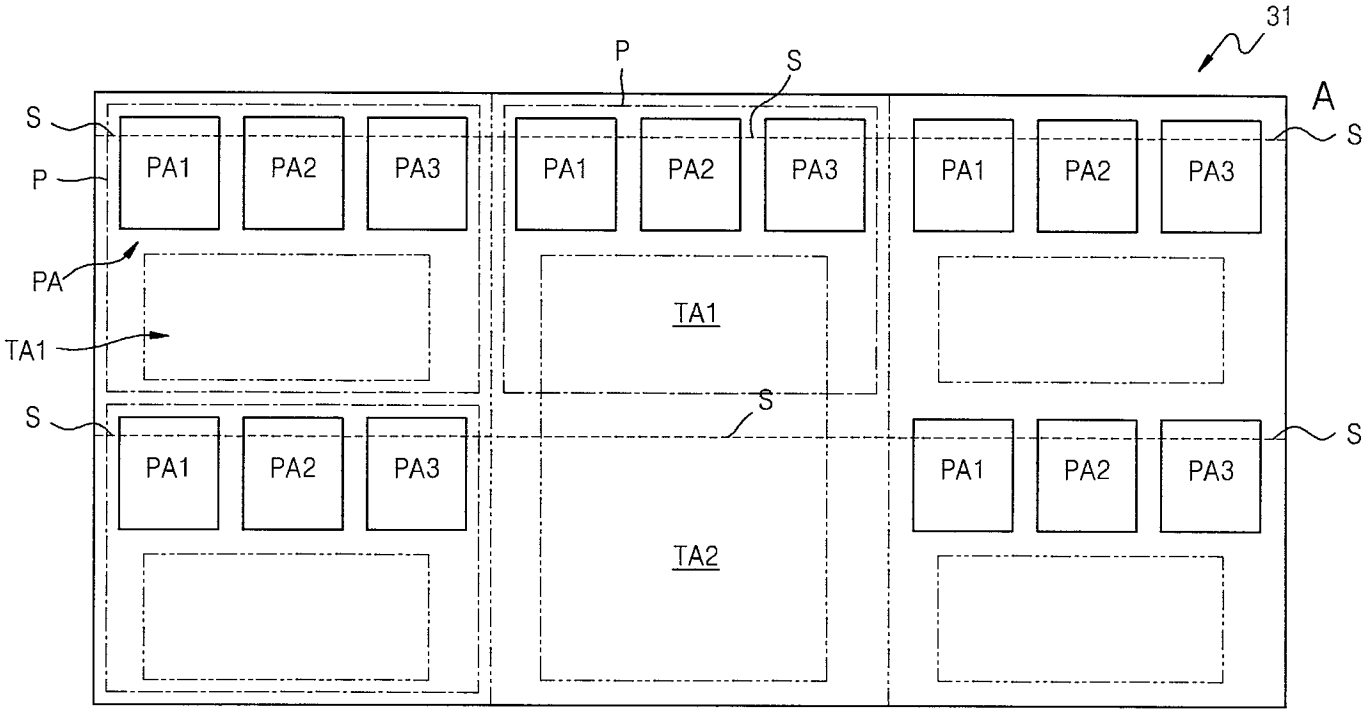
FIG. 11 is a plan view showing part "A" of FIG. 3 according to another embodiment of the present invention.

FIG. 11 is a plane view showing part "A" of FIG. 3 according to another embodiment of the present invention.

Referring to FIGS. 3 and 11, in the first region 31, the first transmitting unit TA1 and the second transmitting unit TA2 may be connected to each other. Accordingly, the second transmitting unit TA2 may be smaller than that shown in FIG. 4, but an image may be smoothly displayed without being cut in the first region 31.

While the present invention has been particularly shown and described with reference to exemplary embodiments thereof, it will be understood by those of ordinary skill in the art that various changes in form and details may be made therein without departing from the spirit and scope of the present invention as defined by the following claims, and equivalent thereof.

What is claimed is:

1. An organic light emitting display apparatus comprising:

a substrate with a first display region and a second display region;

the first display region in which an image is displayed and external light penetrates so that an object positioned on the opposite side of the first display region is capable of being observed by a user; and the second display region in which an image is displayed and external light penetrates so that an object positioned on the opposite side of the second display region is capable of being observed by a user, wherein transmittance of external light of the second display region is lower than that of the first display region.

2. The organic light emitting display apparatus of claim 1, wherein the second display region is connected to the first display region.

3. The organic light emitting display apparatus of claim 1, wherein the first display region and the second display region form one screen.

4. The organic light emitting display apparatus of claim 1, wherein the second region surrounds the first region.

5. The organic light emitting display apparatus of claim 1, wherein the second display region surrounds the first display region.

6. An organic light emitting display apparatus comprising:

a substrate with a first region and a second region;

the first region comprising a plurality of pixels for displaying an image, a first transmitting unit, and a second transmitting unit, the first and second transmitting units being for transmitting external light, and the first transmitting unit being smaller than the second transmitting unit; and the second region comprising a plurality of other pixels for displaying an image and another first transmitting unit for transmitting external light.

7. The organic light emitting display apparatus of claim 1, comprising a plurality of the first transmitting units comprising the first transmitting unit, the plurality of the first transmitting units respectively located inside the plurality of pixels.

8. The organic light emitting display apparatus of claim 1, wherein the second transmitting unit is located between the plurality of pixels.

9. The organic light emitting display apparatus of claim 1, wherein the second transmitting unit is larger than at least one of the plurality of pixels.

10. The organic light emitting display apparatus of claim 1, wherein the second transmitting unit is connected to the first transmitting unit.

11. The organic light emitting display apparatus of claim 1, wherein each of the pixels comprises an emission unit for displaying an image and a pixel circuit unit electrically connected to the emission unit, and wherein the emission unit and the pixel circuit unit of each of the plurality of pixels overlap each other.

12. The organic light emitting display apparatus of claim 1, wherein each of the pixels comprises an emission unit for displaying an image and a pixel circuit unit electrically connected to the emission unit, and wherein the emission unit and the pixel circuit unit of each of the plurality of pixels do not overlap each other.

13. The organic light emitting display apparatus of claim 1, wherein each of the pixels comprises an emission unit for displaying an image and a pixel circuit unit electrically connected to the emission unit, and wherein the first transmitting unit and the second transmitting unit do not overlap the emission units.

14. The organic light emitting display apparatus of claim 1, wherein each of the plurality of pixels comprises an emission unit for displaying an image and a pixel circuit unit electrically connected to the emission unit, and wherein the first transmitting unit and the second transmitting unit do not overlap the pixel circuit units.

15. The organic light emitting display apparatus of claim 1, wherein each of the pixels comprises a first emission unit, a second emission unit, and a third emission unit for emitting light of different colors, respectively, and the first transmitting unit is located to correspond to the first to third emission units of one of the plurality of pixels disposed adjacent to one another.

16. The organic light emitting display apparatus of claim 1, further comprising a common electrode formed over the first and second regions, wherein the common electrode comprises a first opening corresponding to the first transmitting unit and a second opening corresponding to the second transmitting unit.

* * * * *